United States Patent [19]

Henderson

[11] 3,990,208

[45] Nov. 9, 1976

[54] METHOD OF FORMING CONICAL STRUCTURE

[76] Inventor: Charles E. Henderson, 1484 S. Main, Willits, Calif. 95490

[22] Filed: June 2, 1975

[21] Appl. No.: 583,352

[52] U.S. Cl. ..... 52/745; 52/80; 52/82; 52/86; 52/222

[51] Int. Cl.[2] ..... E04B 7/00

[58] Field of Search ..... 52/80, 81, 82, 86, 745, 52/222, 741, 749; 135/19.5, 33 R, 34, 5 R; D88/3 B

[56] References Cited

UNITED STATES PATENTS

| | | | |
|---|---|---|---|
| 1,175,585 | 3/1916 | Berman | 135/19.5 |
| 2,547,770 | 4/1951 | Pelton | 135/5 R |
| 2,767,722 | 10/1956 | Smith | 135/19.5 |
| 3,389,202 | 6/1968 | Waling | 52/80 |
| 3,653,166 | 4/1972 | Kirschen | 52/80 |
| 3,877,186 | 4/1975 | Cartier | 52/82 |

*Primary Examiner*—J. Karl Bell
*Attorney, Agent, or Firm*—Townsend and Townsend

[57] ABSTRACT

A method of forming the roof/wall portion of a conical building structure is disclosed. A generally two-dimensional panel structure is first constructed at or near ground level. The panel structure has a shape generally comprising from one to three contiguous quadrants of a theoretical square configuration. This shape has at least one primary peripheral corner coincident with one of the corners of the square configuration, and two secondary peripheral corners intermediate the corners of the square configuration. The secondary peripheral corners are formed by a peripheral edge of the panel structure coincident with the boundary of the square configuration and a secondary edge directed inwardly with respect to that boundary. The panel structure so formed is flexed into a downwardly opening conical configuration. In this configuration, the two secondary peripheral corners are proximate one another so that the secondary edges are contiguous and the flexed panel structure thus provides a continuous roof/wall structure.

17 Claims, 11 Drawing Figures

METHOD OF FORMING CONICAL STRUCTURE

BACKGROUND OF THE INVENTION

The present invention relates to building construction, and in particular to a method of forming the roof/wall portion of a conical building structure.

One of the principal problems in housing construction is the spiralling cost of constructing a single family dwelling. The cost of such dwellings has risen to the point that a single family dwelling is becoming unfeasible for low and middle income families. The principal factor in the rise in the cost of constructing single family dwellings and other building structures is the labor cost involved. Conventional construction techniques rely almost exclusively on the use of labor, and thus the cost cannot be reduced without reducing the salaries paid to the laborers. Such salaries continually increase rather than decrease and thus the construction cost inexorably rises. Attempts have been made to minimize such labor cost by preassembling such structures in factories, either in whole or in part, but such attempts to reduce the cost of construction have met with only moderate success. The source of the problem appears to be the use of excessive labor in conventional construction techniques, and the only way that the problem can be reduced or minimized is to change the techniques themselves.

SUMMARY OF THE INVENTION

The present invention provides a method of forming a roof/wall portion of a conical building structure. A generally two-dimensional panel structure is first constructed at or near ground level. The panel structure has a shape generally comprising from one to three contiguous quadrants of a theoretical square configuration. This shape has at least one primary peripheral corner coincident with one of the corners of the square configuration, and two secondary peripheral corners intermediate the corners of the square configuration. The secondary peripheral corners are formed by a peripheral edge of the panel structure coincident with the boundary of the square configuration and a secondary edge directed inwardly with respect to that boundary. The panel structure so formed is flexed into a downwardly opening conical configuration. In this configuration, the two secondary peripheral corners are proximate one another so that the secondary edges are contiguous and the flexed panel structure thus provides a continuous roof/wall structure.

It is immediately apparent that the present invention provides a technique for constructing a roof/wall structure bearing little resemblance to conventional construction techniques. Rather, the roof/wall structure is initially assembled at ground level, preferably on the foundation for the eventual building. After assembly, the roof/wall structure is erected by flexing the panel structure until complementary edges thereof meet so that a continuous roof/wall structure is provided. Additional side walls can then be added to complete the building structure.

In the preferred embodiment of the present invention, the panel structure comprises a plurality of rectangular plywood panels. The plywood panels are arranged so that their edges overlap and they can be simply bolted together at ground level to form the panel structure. After the panel structure has been so formed, it can easily be erected by flexing the panel structure as indicated to provide the continuous roof/wall structure. It is anticipated that the ease with which the roof/wall structure can be constructed greatly reduces the labor cost involved, and correspondingly decreases the cost of such building structures.

The novel features which are believed to be characteristic of the invention, both as to organization and method of operation, together with further objects and advantages thereof will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENTS

Figure 1:
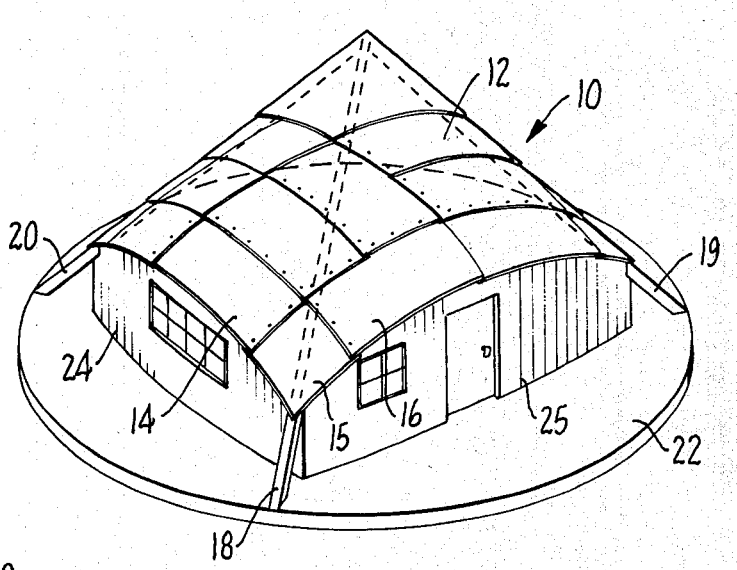
FIG. 1 is a perspective view of a building constructed according to the teachings of the present invention.

A building 10 formed according to the teachings of the first embodiment of the present invention is illustrated in FIG. 1. Building 10 has a roof/wall structure 12 formed from a plurality of plywood elements such as 14–16 and having a downwardly opening conical shape. Roof/wall structure 12 is mounted on three generator beams 18–20 mounted to a foundation 22. Curved sidewalls such as 24, 25 extend from foundation 22 to roof/wall structure 12 to complete the building.

Figure 3:
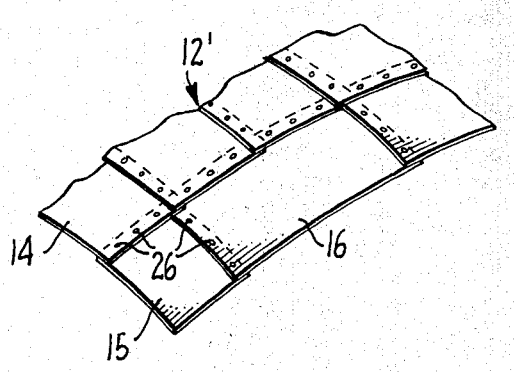
FIG. 3 is a fragmentary perspective view of a portion of the panel structure of FIG. 2.

To construct the roof/wall structure illustrated in FIG. 1, a two-dimensional panel structure 12' is initially constructed on the foundation at or near ground level. It is preferred that panel structure 12' be constructed from a plurality of rectangular plywood panels such as 14, 16. Square panels such as 15 are used at the corners. Panel structure 12 can easily be constructed by overlapping the edges of the plywood panels as illustrated in FIG. 3, and connecting the overlapping edges of the panels by bolts 26.

Plywood panels are normally manufactured in a rectangular configuration. A typical size is a 4 foot by 8 foot panel. Plywood in this form is readily available, and therefore it is preferred to construct panel structure 12′ from such panels. However, it is apparent that panel structure 12′ could be constructed from panels having different configurations. Furthermore, it is possible that materials other than plywood could be used, and it is even possible that panel structure 12′ could be formed with certain types of materials as a single unitary element.

Figure 2:
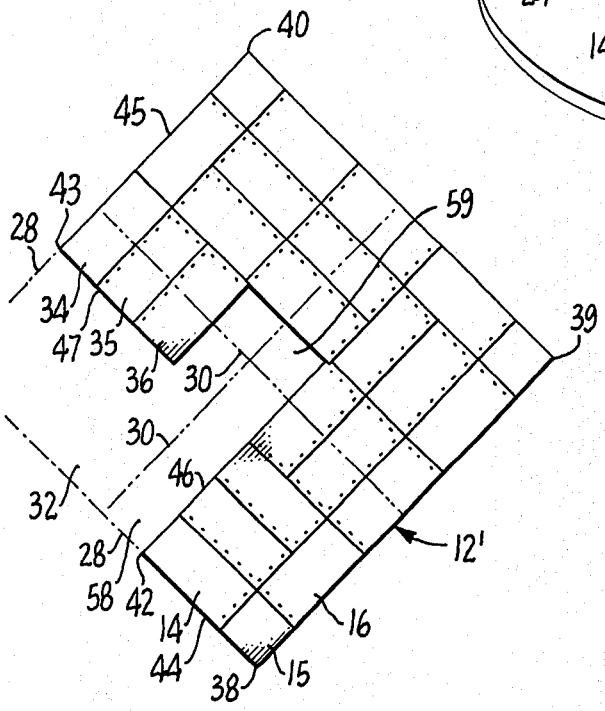
FIG. 2 is a plan view of the panel structure used to form the roof/wall portion of the building illustrated in FIG. 1.

In the plan view of panel structure 12′, illustrated in FIG. 2, the panel structure is superimposed over a theoretical square illustrated by single dash lines 28. The overall shape of panel strucure 12′ generally corresponds with three quadrants of square 28, delineated by double dash lines 30. One quadrant 32 of square 28 is generally vacant, although three rectangular panels 34–36 extend partially into that quadrant.

Panel structure 12′ has three primary peripheral corners 38–40 coincident with three of the corners of theoretical square 28. In addition, panel structure 12′ has two secondary peripheral corners 42, 43 intermediate adjacent corners of square 28. Each secondary peripheral corner 42, 43 consists of one edge 44, 45 coincident with the boundary of square 28 and a second edge 46, 47 extending inwardly from the boundary of the square.

Figure 4:
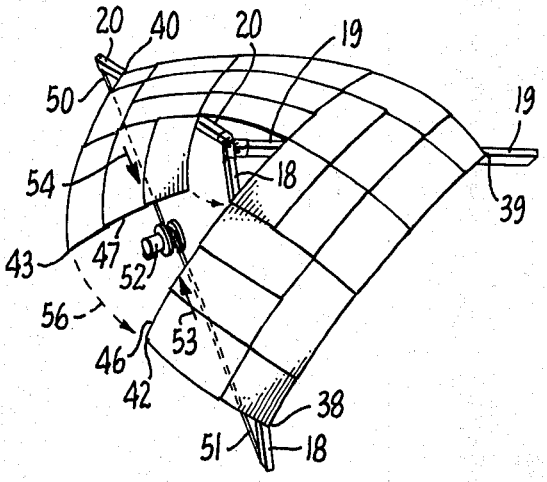
FIG. 4 illustrates the manner in which the panel structure shown in FIG. 2 may be flexed to form the roof/wall structure of FIG. 1.

In order to raise the panel structure 12′ and form it into the roof/wall structure 12 illustrated in FIG. 1,the panel structure is flexed as depicted in FIG. 4. Initially, the generator beams 18–20 are inserted beneath panel structure 12′ and attached thereto. Generator beams 18–20 are pivotably joined together at one end as illustrated, and extend outwardly so as to bisect primary peripheral corners 38–40 respectively of panel structure 12′. Alternately, generator beams 18–20 can initially be laid on the foundation, and panel structure 12′ formed overlying the generator beams.

The outer ends of generator beams 18–20 are drawn together to flex panel structure 12′. As illustrated in FIG. 4, cables 50, 51 can be attached to the ends of the generator beams and drawn together by a winch 52 as illustrated by arrows 53, 54. As a result, panel structure 12 flexes upwardly at the center, and secondary peripheral corners 42, 43 are drawn together as illustrated by arrow 56.

It may also be possible to flex panel structures 12′ by raising generator beams 18–20 at their connected ends, the foot of beam 19 being fixed, to accomplish the same objective.

Figure 5:
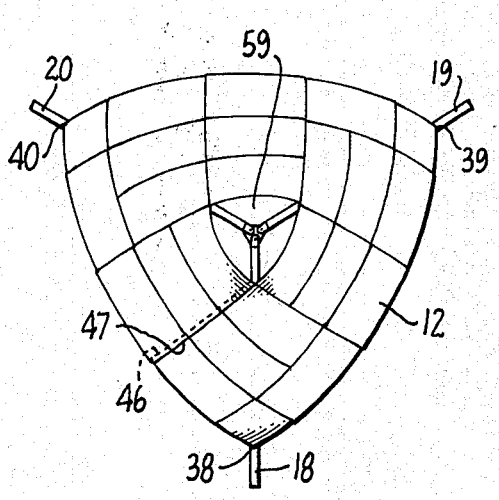
FIG. 5 is a top view of the building of FIG. 1.

It is apparent from FIG. 4 that when secondary peripheral corners 42, 43 are proximate one another, secondary edges 46, 47 will be contiguous to provide the continuous roof/wall structure 12 illustrated in FIG. 5. When roof/wall structure 12 is fully erected, generator beams 18–20 will be equidistant, and the roof/wall structure will be in the shape of a downwardly opening cone having three depending corners 38–40 corresponding to the primary peripheral corners of panel structure 12′.

As discussed previously, panel structure 12′ is constructed by joining the overlapped edges of a plurality of rectangular plywood panels. It is preferred that the panels overlap in such a manner that when the panel structure is erected to form roof/wall structure 12, the edges of the higher plywood panels overlie the corresponding edges of the lower panels. In this manner, a shingling effect will be achieved to facilitate the run-off of water from the structure and avoid the formation of recesses in the roof/wall structure in which rain water and other materials can collect.

By viewing the erection of panel structure 12′ as illustrated in FIG. 4, the necessity for the odd shape of the panel structure 12′ as illustrated in FIG. 2 becomes apparent. When panel structure 12 inclined is lying flat, it generally comprises three quadrants of a theoretical square configuration. However, when panel structure 12′ is flexed to form roof/wall structure 12, the structure collapses into a downwardly opening conical configuration and provides a continuous roof/wall structure.

Theoretically, the panel structure should occupy precisely the three quadrants of square 28, but in practice this shape is somewhat modified. Rectangular panels 34–36 extend partially into the theoretically vacant quadrant, and one of the occupied quadrants 58 is partially vacant. The reason for this departure from the theoretical shape is to make optimum utilization of rectangular panels because such panels can be readily obtained. If square panels were used, the theoretical shape could be followed more closely.

A second modification to the theoretical shape of the panel structure results from the limited ability of structural panels such as plywood to flex. A vacant space 59 is provided near the center of the theoretical square 28. When panel structure 12′ is erected, this vacant space 59 remains at the top of roof/wall structure 12, as illustrated in FIG. 5. If this vacant space 59 were not provided, extreme flexure would be required of the panel in this space when the panel structure is erected, more flexure than plywood can withstand. Thus, this space is left vacant and later filled with a specially constructed cap to complete the roof/wall structure.

With the modifications to the theoretical shape of panel structure 12′ discussed above, the structure does not conform precisely to the three quadrants of theoretical square 28. However, the shape does conform generally to such a configuration, and the term "generally comprising three quadrants of a square configuration" is used herein to designate modifications which may be made from the theoretical shape to satisfy practical considerations.

Figure 6:
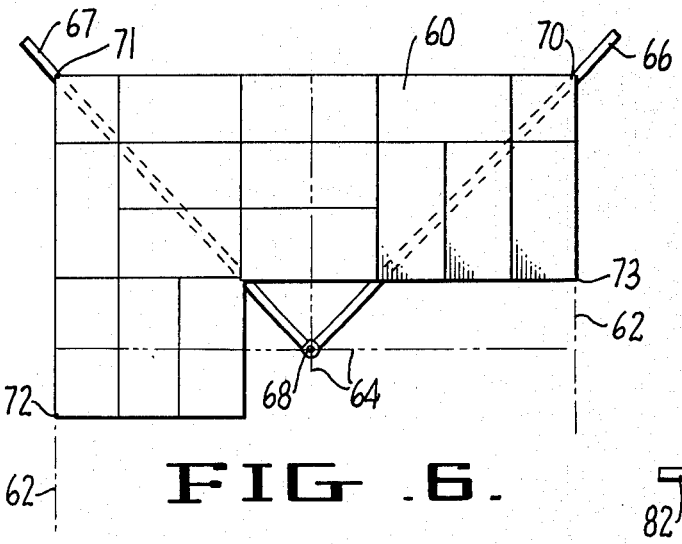
FIG. 6 is a plan view of an alternative embodiment of the present invention used to form a roof/wall structure having two depending corners.
Figure 7:
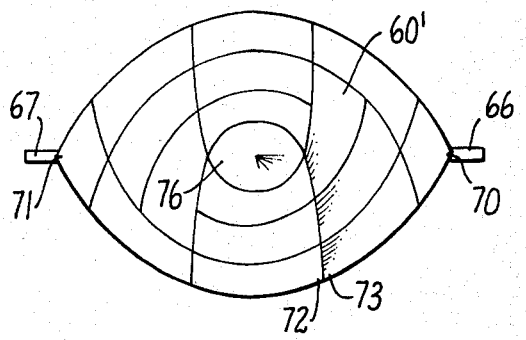
FIG. 7 is a top view of a roof/wall structure constructed from the panel structure illustrated in FIG. 6.
Figure 8:
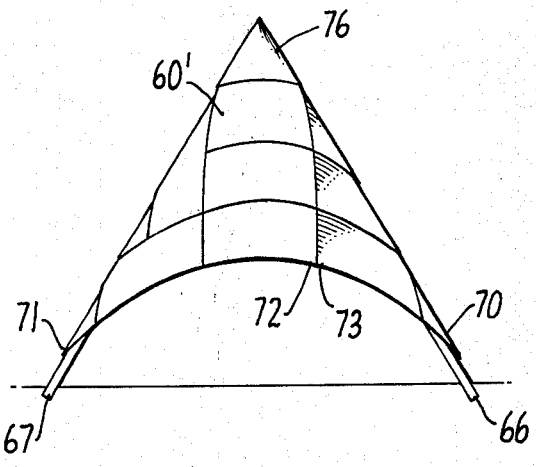
FIG. 8 is an elevation view of the roof/wall structure of FIG. 7.

A second embodiment of the present invention is illustrated in FIGS. 6–8. The panel structure 60 used in this embodiment is constructed by a plurality of rectangular plywood panels joined together at their overlapping edges as illustrated in FIG. 6. Again, panel structure 60 is superimposed on a theoretical square depicted by single dash line 62 which is divided into quadrants by double dash lines 64. It is immediately apparent that panel structure 60 generally comprises two contiguous quadrants of square 62. As in the previous embodiment, panel structure 60 does not precisely conform to such two quadrants because of practical considerations such as the use of rectangular panel elements and the limited flexure which the elements can withstand.

Panel structure 60 is constructed over a pair of generator beams 66, 67. The generator beams are pivotably interconnected at 68, and extend outwardly through and bisect primary peripheral corners 70, 71 of panel structures 60. As with the previous embodiment, primary peripheral corners 70, 71 coincide with corners of theoretical square 62. In addition, panel structure 60 has a pair of secondary peripheral corners 72, 73 intermediate the corners of the theoretical square.

As depicted in FIGS. 7 and 8, a roof/wall structure 60′ is formed by flexing panel structure 60 into a downwardly opening conical shape. Secondary corners 72, 73 are drawn together to form a continuous roof/wall structure, and peak 76 is added. Primary corners 70, 71 depend downwardly from roof/wall structure 60′, and the entire roof/wall structure rests on generator beams 66, 67. Side walls can be added to the roof/wall structure to provide a completed building.

Figure 9:
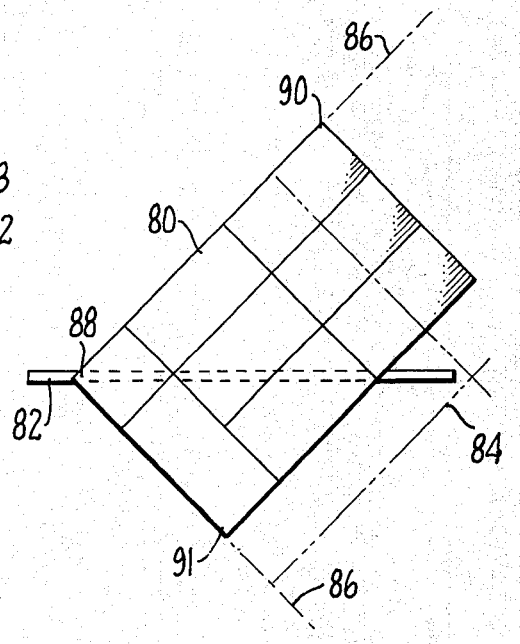
FIG. 9 is a plan view of another alternative embodiment of the present invention adapted to form a roof/wall structure having one depending corner.
Figure 10:
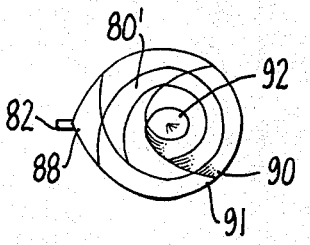
FIG. 10 is a top view of a roof/wall structure formed with the panel structure of FIG. 9.
Figure 11:
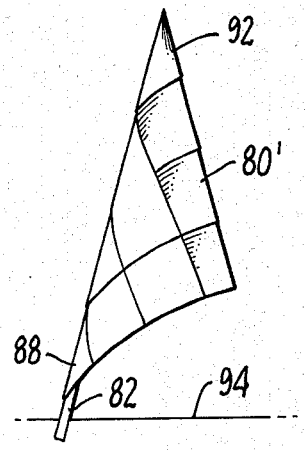
FIG. 11 is an elevation view of the roof/wall structure of FIG. 10.

A third embodiment of the present invention is illustrated in FIGS. 9–11. In this embodiment, a panel structure 80 is constructed over a single generator beam 82. Panel structure 80 generally comprises a single quadrant 84 of a theoretical square 86, and can be constructed by bolting overlapping rectangular plywood panels as in the previous embodiments. Panel structure 80 has a single primary corner 88 coincident with one corner of theoretical square 86. Secondary corners 90, 91 are provided intermediate the corners of theoretical square 86.

As with the previous embodiments, panel structure 80 is flexed into a downwardly opening conical shape to provide a roof/wall structure 80′ illustrated in FIGS. 10 and 11. Secondary peripheral corners 90, 91 are drawn together to provide continuous roof/wall structure 80′, and a cap 92 is added to complete the structure. In the embodiments of FIGS. 9–11 roof/wall structure 80′ is initially mounted on single generator beam 82. Additional conventional side walls can be added to join roof/wall structure 80′ to foundation 94 to complete the building and further support the roof/wall structure.

It is apparent that the various embodiments illustrated above can easily be used to form a relatively small building structure, such as may be desired for a single family dwelling. A relatively flat roof structure is formed with the first embodiment, and structures have progressively higher aspect ratios are formed with the second and third embodiments. Each of the embodiments is based on a single principle, however, the construction at ground level of a panel structure and the flexing of that structure to form a downwardly opening conical shape which provides the roof/wall portion of a building.

While preferred embodiments of the present invention have been illustrated in detail, it is apparent that modifications and adaptations of those embodiments will occur to those skilled in the art. However, it is to be expressly understood that such modifications and adaptations are within the spirit and scope of the present invention, as set forth in the following claims.

What I claim as new is:

1. A method of forming the roof/wall portion of a conical building structure comprising the steps of:

constructing a generally two-dimensional building panel structure, said panel structure having a shape generally comprising from one to three contiguous quadrants of a theoretical square configuration and having at least one primary peripheral corner, each said primary peripheral corner being coincident with one of the corners of the square configuration, and two secondary peripheral corners intermediate the corners of the square configuration, each said secondary peripheral corner formed by a peripheral edge of the panel structure coincident with the boundary of the square configuration and a secondary edge directed inwardly with respect to the boundary of the square configuration; and flexing the panel structures into a downwardly opening conical building roof/wall with the two said secondary peripheral corners being proximate one another so that said secondary edges are contiguous, whereby the panel structure provides a continuous roof/wall structure with each said primary peripheral corner depending downwardly therefrom.

2. A method as recited in claim 1 wherein said constructing step includes the step of joining a plurality of structural panels together to construct said two-dimensional panel structure.

3. A method as recited in claim 2 wherein said structural panels comprise rectangular plywood panels.

4. A method as recited in claim 1 wherein said flexing step includes the step of drawing the two secondary peripheral corners together to flex the panel structure.

5. A method as recited in claim 1 wherein a panel structure has a shape generally comprising three contiguous quadrants of the square configuration having three primary peripheral corners.

6. A method as in claim 1 wherein the panel structure has a shape generally comprising two contiguous quadrants of the square configuration so that the panel structure has two primary peripheral corners.

7. A method as recited in claim 1 wherein the panel structure has a shape generally comprising one quadrant of the square configuration so that the panel structure has one primary peripheral corner.

8. A roof/wall structure formed according to the method of claim 1.

9. A method of forming the roof/wall portion of a conical building structure comprising the steps of:

joining a plurality of structural building panels together to construct a generally two-dimensional panel structure, said panel structure having a shape generally comprising from one to three contiguous quandrants of a theoretical square configuration and having at least one primary peripheral corner, each said primary peripheral corner being coincident with one of the corners of the square configuration, and two secondary peripheral corners intermediate the corners of the square configuration, each said secondary peripheral corner formed by a peripheral edge of the panel structure coincident with the boundary of the square configuration and a secondary edge of the panel structure directed inwardly with respect to the edge of the square configuration; and flexing the panel structure into a downwardly opening conical building roof/wall with the two said secondary peripheral corners being proximate one another so that said secondary edges are contiguous whereby the panel structure provides a continuous roof/wall structure with each said primary peripheral corner depending downwardly therefrom.

10. A method as recited in claim 9 wherein certain of the panels comprise rectangular plywood panels, and wherein said joining step comprises the step of overlapping adjacent edges of said panels and bolting the panels together to construct the two-dimensional panel structure.

11. A method as recited in claim 10 wherein one dimension of the rectangular panels is approximately twice the other, orthogonal dimension.

12. A method as recited in claim 9 and additionally comprising the step of connecting at least one generator beam to the underside of the array so that the end of each said beam extends outwardly from the array and bisects one of the respective primary peripheral corners thereof.

13. A roof/wall structure formed according to the method of claim 9.

14. A method as recited in claim 10 wherein said overlapping step includes overlapping said adjacent edges to create a shingling effect when the panel structure is flexed.

15. A method of forming the roof/wall portion of a conical building structure comprising the steps of:

joining a plurality of structural building panels together to form a two-dimensional array of said panels having a shape generally comprising three quadrants of a square configuration, said array having three primary peripheral corners coincident with three of the corners of the square configuration and two secondary peripheral corners intermediate the corners of the square configuration, each said secondary peripheral corner formed by a peripheral edge of the array coincident with the boundary of the square configuration and a secondary edge directed inwardly with respect to said boundary; and drawing the two said secondary peripheral corners together so that the secondary edges are coincident and simultaneously allowing the array to flex upwardly into a downwardly opening conical building roof/wall to form a continuous roof/wall structure with the three primary peripheral corners of the array depending from said structure and being equidistant one from the other.

16. A method as recited in claim 15 and additionally comprising the step of connecting three generator beams to the underside of the array, said beams being pivotably interconnected at one end and extending outwardly from the array so that each said beam bisects one of the respective primary peripheral corners.

17. A roof/wall structure formed according to the method of claim 15.

* * * * *